US007934455B2

(12) United States Patent
Winter

(10) Patent No.: US 7,934,455 B2
(45) Date of Patent: May 3, 2011

(54) SUB-CALIBER PROJECTILE

(76) Inventor: Udo Winter, Linz (AT)

( * ) Notice: Subject to any disclaimer, the term of this patent is extended or adjusted under 35 U.S.C. 154(b) by 0 days.

(21) Appl. No.: 12/083,320

(22) PCT Filed: Oct. 12, 2006

(86) PCT No.: PCT/AT2006/000422

§ 371 (c)(1),
(2), (4) Date: Apr. 9, 2008

(87) PCT Pub. No.: WO2007/041741

PCT Pub. Date: Apr. 19, 2007

(65) Prior Publication Data

US 2009/0151593 A1 Jun. 18, 2009

(30) Foreign Application Priority Data

Oct. 13, 2005 (AT) ..... A 1675/2005

(51) Int. Cl.
*F42B 14/06* (2006.01)

(52) U.S. Cl. ..... 102/517; 102/521

(58) Field of Classification Search ..... 102/516, 102/517, 518, 520, 521, 522
See application file for complete search history.

(56) References Cited

U.S. PATENT DOCUMENTS

| | | | | | |
|---|---|---|---|---|---|
| 33,863 | A * | 12/1861 | Woodbury | 244/3.23 |
| 1,892,152 | A * | 12/1932 | Jones | 102/518 |
| 2,121,796 | A * | 6/1938 | Helbich | 102/517 |
| 2,414,863 | A * | 1/1947 | Foster | 102/517 |
| 2,838,000 | A * | 6/1958 | Schreiber | 102/507 |
| 3,260,207 | A | 7/1966 | Kreuzer | |
| 3,349,711 | A * | 10/1967 | Darigo et al. | 102/509 |
| 3,713,388 | A * | 1/1973 | Pontoriero | 102/436 |
| 4,063,511 | A * | 12/1977 | Bullard | 102/436 |
| 4,336,756 | A * | 6/1982 | Schreiber | 102/516 |
| 5,069,139 | A * | 12/1991 | Denis | 102/518 |
| 5,133,261 | A * | 7/1992 | Kelsey, Jr. | 102/439 |
| 5,175,392 | A * | 12/1992 | Denis | 102/364 |
| 5,299,501 | A * | 4/1994 | Anderson | 102/364 |
| 5,408,931 | A * | 4/1995 | Tallman | 102/439 |
| 6,186,071 | B1 * | 2/2001 | Fry | 102/515 |
| 6,186,072 | B1 * | 2/2001 | Hickerson et al. | 102/518 |
| 6,244,187 | B1 * | 6/2001 | Head | 102/516 |
| 6,799,519 | B2 * | 10/2004 | Meyer et al. | 102/522 |
| 6,845,717 | B1 * | 1/2005 | Sauvestre | 102/518 |

FOREIGN PATENT DOCUMENTS

| | | |
|---|---|---|
| DE | 583 098 | 8/1933 |
| FR | 1 405 729 | 7/1965 |

* cited by examiner

*Primary Examiner* — Bret Hayes

(74) *Attorney, Agent, or Firm* — Collard & Roe, P.C.

(57) ABSTRACT

A sub-caliber projectile is described for insertion into a projectile receptacle (8) having a projectile head (1) and a tail unit (2) forming guide vanes (4), which engages in a cavity of the projectile head (1). To provide advantageous construction conditions, it is suggested that the guide vanes (4) of the tail unit (2) extend up into the hollow projectile head (1) and the projectile head (1) be folded clamped into the groin area between the guide vanes (4).

18 Claims, 5 Drawing Sheets

SUB-CALIBER PROJECTILE

CROSS REFERENCE TO RELATED APPLICATIONS

This application is the National Stage of PCT/AT2006/000422filed on Oct. 12, 2006, which claims priority under 35 U.S.C. §119 of Austrian Application No. A 1675/2005 filed on Oct. 13 , 2005. The international application under PCT article 21(2) was not published in English.

1. Field Of The Invention

The invention relates to a sub-caliber projectile for use in a projectile receptacle having a projectile head and a tail unit forming guide vanes, which engages in a cavity of the projectile head.

2. Description Of The Prior Art

Sub-caliber projectiles require a projectile receptacle for sealing the projectile in relation to the barrel of a shotgun, for example. The projectile receptacle, which may be implemented as a propellant cup, sabot, or propellant collar, is inserted together with the projectile in a cartridge casing, from which it is driven out after the firing of the propellant charge of the cartridge with the aid of the resulting propellant gases together with the projectile in the barrel. After leaving the barrel, the projectile receptacle is separated from the projectile, which flies further. For this purpose, the projectile receptacle may be provided with intended separation points distributed around the circumference, which cause an umbrella-like spreading of the projectile receptacle and thus detachment from the projectile when the projectile receptacle exits from the barrel. To ensure a stable flight path for the projectile, which flies further, the projectile may have a tail unit having guide vanes projecting radially from the projectile body (U.S. Pat. No. 4,434,718 A). Because different uses require different projectiles, different projectile shapes are provided for different intended uses, which require additional adaptation of the projectile receptacle in particular for sub-caliber projectiles.

In order that a center-of-gravity location advantageous for the flight stability may be ensured in sub-caliber projectiles, assembling the projectile from a projectile head and a tail unit separate therefrom, which comprises a material lighter than the projectile head, is additionally known (DE 583 098 B). To connect projectile head and tail unit, the tail unit has a connection projection having a widened head, which is anchored in a corresponding undercut receptacle recess in the base of the projectile head. A complex production method results because this connection requires a melting procedure.

SUMMARY OF THE INVENTION

Proceeding from a sub-caliber projectile of the type described at the beginning, the invention is thus based on the object of providing a simple, less cumbersome production of sub-caliber projectiles for various intended uses, without having to adapt the projectile receptacle in each case.

The invention achieves the stated object in that the guide vanes of the tail unit extend up into the hollow projectile head, and the projectile head is folded clamped into the groin area between the guide vanes.

Because the projectile head extends into the area of the guide vanes of the tail unit as a result of these measures, the tail unit may be connected in a formfitting and permanent manner to the hollow projectile head by simply folding in a wall section in the groin area between the guide vanes of the tail unit. This clamp connection allows the use of a uniform shape of the tail unit for different projectile heads with the advantage that not only is the production effort reduced, but rather also additional adaptation of the projectile receptacle to the various projectiles may be dispensed with, because in general the tail unit determines the shape of the projectile receptacle, in particular if the tail unit extends up into the projectile head.

In addition, the projectile head is centered in relation to the tail unit without additional measures by the clamping folding in of the wall section.

Although various embodiments are possible for the tail units, especially favorable flight conditions result if the tail unit has a main body tapering away from the projectile head, from which the wings tapering off toward the projectile head project radially.

Because the projectile head has to receive the tail unit, the capability of housing active agents in the projectile head is restricted. To nonetheless be able to use projectiles according to the invention as carriers for a sufficient quantity of such active agents, the tail unit may be implemented as a hollow. This cavity of the tail unit may also be used as the receptacle of an auxiliary compound or as the receptacle chamber for propellant gases, to displace the projectile center of gravity or to support the detachment of the projectile receptacle through the propellant gases flowing out of the cavity of the tail unit after the projectile exits from a barrel, for example. It does not have to be emphasized further here that the tail unit may also be equipped with a tracer unit at the rear end of the main body of the tail unit.

If the tail unit has a section which is setback by the wall thickness of the hollow projectile head and receives the projectile head, a continuous transition from the projectile head to the tail unit may be ensured easily, which improves the flight properties of the projectile. To further improve the flight properties, the vanes of the tail unit may form a control surface inclined in relation to an axial plane in the area of its rear end, which ensures a torque around the projectile axis because of the flow conditions against it, so that the flight stability is increased as a result of the rotation of the projectile around its axis connected thereto.

The projectile head may have a setback annular shoulder, which is not only used for the axial support of the projectile receptacle in relation to the projectile, but rather also may provide a contribution to the flight stabilization of the projectile. If the annular shoulder is shaped into an axial annular web having radial notches or slots distributed around the circumference, the effect of the projectile upon incidence on the target may additionally be lastingly influenced, because this annular web tears apart axially as a result of the notches and/or slots and is bent radially outward. A similar effect may be achieved by other implementations of the projectile head, for example, in that the projectile head has an annular bead formed by a centric or annular recess on the front face, which is provided with radial notches or slots distributed around the circumference, which in turn result in an expansion of the annular bead upon incidence of the projectile on a target. To support the mushrooming expansion of the projectile head, the centric recess in the projectile head may extend up to the cavity of the tail unit, a spreading core projecting into the cavity of the tail unit being inserted into the recess, which engages with an annular shoulder in an expansion of the recess provided adjoining the tail unit in the projectile head. Upon incidence of the projectile on the target, the annular bead is additionally expanded with the aid of the annular shoulder of the spreading core by the kinetic energy of the spreading core, by which the effect of the projectile is improved.

To improve the penetrating power of the projectile, the projectile head may have an insert made of a heavier material, whose greater kinetic energy may be used for specific intended purposes. If a softer insert is selected, the plastic deformation of the insert may be used for a special projectile effect upon incidence on a harder target. The projectile head may also be molded from a granular material, however, which disintegrates upon incidence on a target.

To increase the penetrative force of a projectile, an opening which lengthens the cavity of the tail unit may also be provided in the projectile head to receive a hard projectile core extending into the cavity of the tail unit, which, upon joining of projectile head and tail unit, is held between these design parts without additional measures. Because of its kinetic energy, the projectile core penetrates the front face of the projectile head upon incidence of the projectile on the target and penetrates into the target object.

BRIEF DESCRIPTION OF THE DRAWING

The subject matter of the invention is illustrated as an example in the drawing.

DESCRIPTION OF THE PREFERRED EMBODIMENT

Figure 1:
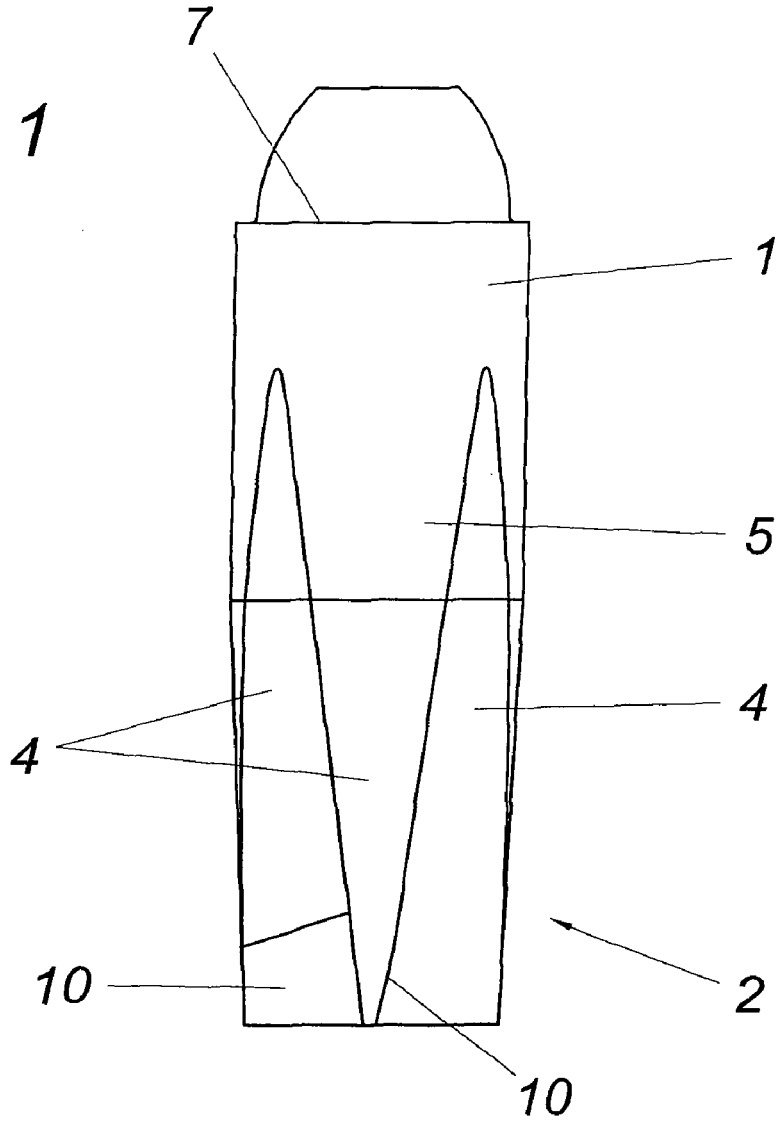
FIG. 1 shows a projectile according to the invention in a simplified side view.

The projectile according to the exemplary embodiment from FIGS. 1 through 4 has a projectile head 1 and a tail unit 2 having guide vanes 4 projecting radially from a main body 3. The configuration is selected in such a manner that the main body 3 tapers away from the projectile head 1 toward the projectile base, while the guide vanes 4 taper off toward the projectile head 1. The projectile head 1 is implemented as hollow and has a pot shape, whose wall is identified by 5. An axial section 6 of the tail unit 2 engages in this pot shape of the projectile head 1, as may be inferred from FIGS. 3 and 4 in particular. The guide vanes 4 extend up into the area of the projectile head 1, whose wall 5 is folded into the groin area between the guide vanes 4, which is obvious above all from FIGS. 3 and 4. This folding in of the wall 5 in accordance with the course of the guide vanes 4 provides a formfitting, self-centering clamped seat between the projectile head 1 and the tail unit 2. Because the axial section 6 of the tail unit 2 is set back by the thickness of the wall 5 of the projectile head 1, a continuous transition between the projectile head 1 and the tail unit 2 in the area of the external surface results for the projectile, so that advantageous flow conditions may be maintained for the projectile.

Figure 3:
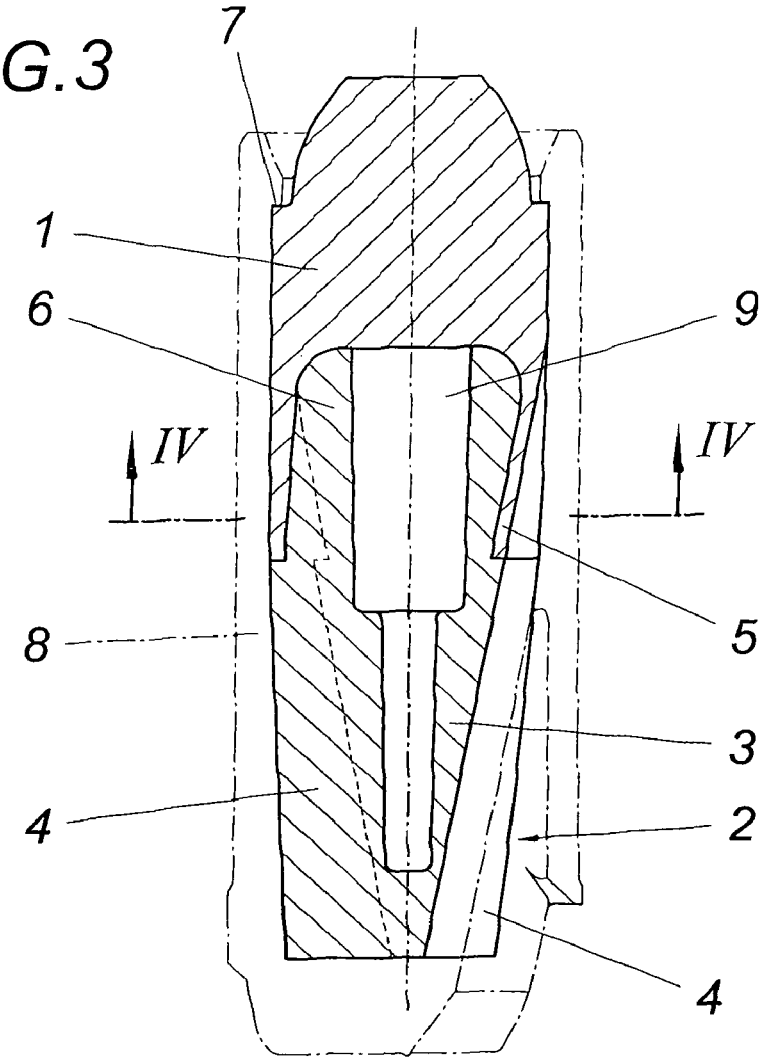
FIG. 3 shows a section along line III-III of FIG. 2.
Figure 4:
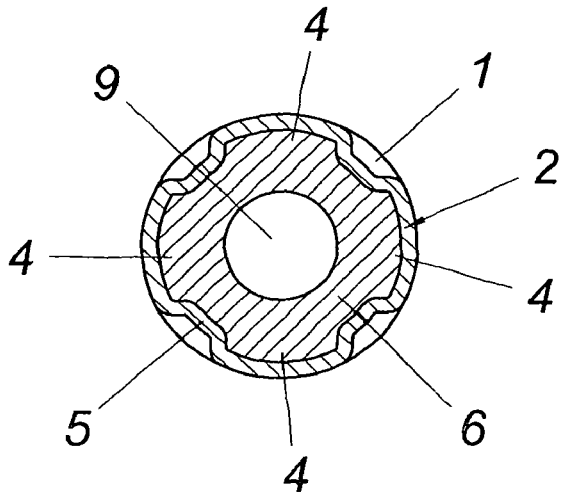
FIG. 4 shows a section along line IV-IV of FIG. 3, and FIGS. 5 through 10 each show different embodiments of a projectile according to the invention in a partially cutaway side view.

The projectile head 1 is provided with a setback annular shoulder 7, which on one hand improves the flight stability of the projectile and on the other hand is used for an axial support of a projectile receptacle 8, indicated by dot-dash lines in FIG. 3. This projectile receptacle 8, which is implemented as a propellant cup according to the exemplary embodiment, causes a seal of the sub-caliber projectile in the barrel from which the projectile is fired. The projectile is therefore also inserted together with the projectile receptacle 8 in a cartridge casing, which receives the propellant charge between the cartridge base and the propellant cup.

Because of the division of the projectile into a projectile head 1 and a tail unit 2 manufactured separately from the projectile head 1, which is permanently connected to the projectile head by folding in the wall 5 of the projectile head in the groin area between the guide vanes 4 of the tail unit, advantageous conditions are provided for the production of various projectiles, without having to tailor the projectile receptacle 8 to the particular projectile, because the tail unit 2, which extends over a significant length of the projectile, may be used for various projectiles without a shape change. To be able to take different embodiments of the projectile into consideration, the tail unit 2 may additionally be implemented as hollow, so that if needed the cavity 9 may be used for receiving an active agent or an additional compound.

Figure 2:
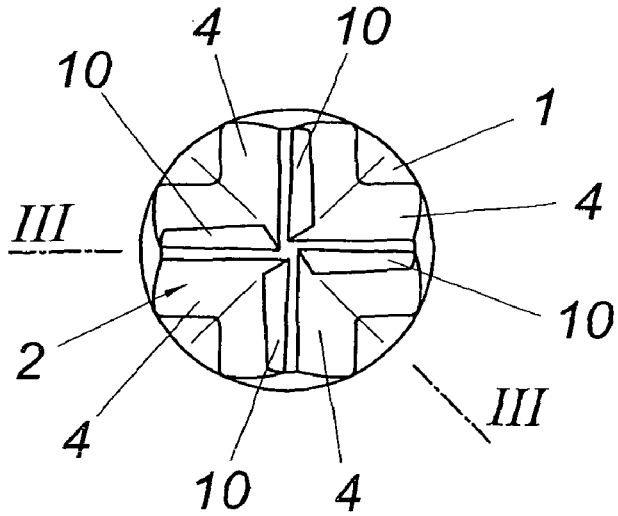
FIG. 2 shows the projectile from FIG. 1 in a base view.

Although the sub-caliber projectile already provides good flight properties because of the tail unit 2, the flight stability may be improved further if the guide vanes 4 form a control surface 10 inclined in relation to an axial plane in the area of its rear end, as indicated in FIGS. 1 and 2. These control surfaces 10 cause a torque on the projectile because of the air flowing against them, which sets the projectile into rotation around its longitudinal axis, so that the flight stability of the projectile may be improved by the twist thus achieved.

Various embodiment variants are illustrated in FIGS. 5 through 10, which may be produced easily because of the design of the projectile according to the invention. However, this selection is only exemplary and does not preclude other embodiments. According to the exemplary embodiment from FIG. 5, which shows a tail unit 2 corresponding to the exemplary embodiment from FIGS. 1 through 4, the annular shoulder 7 is implemented as an axial annular web 11, which has radial notches 12 distributed around the circumference, so that because of the notch effect, the annular web 11 tears open upon incidence on a target and the sectors of the annular web 11 formed by the tearing are bent radially outward. In addition, the cavity 9 of the tail unit 2 is filled up with an auxiliary compound 13 to increase the projectile weight and achieve a center of gravity displacement.

Figure 6:
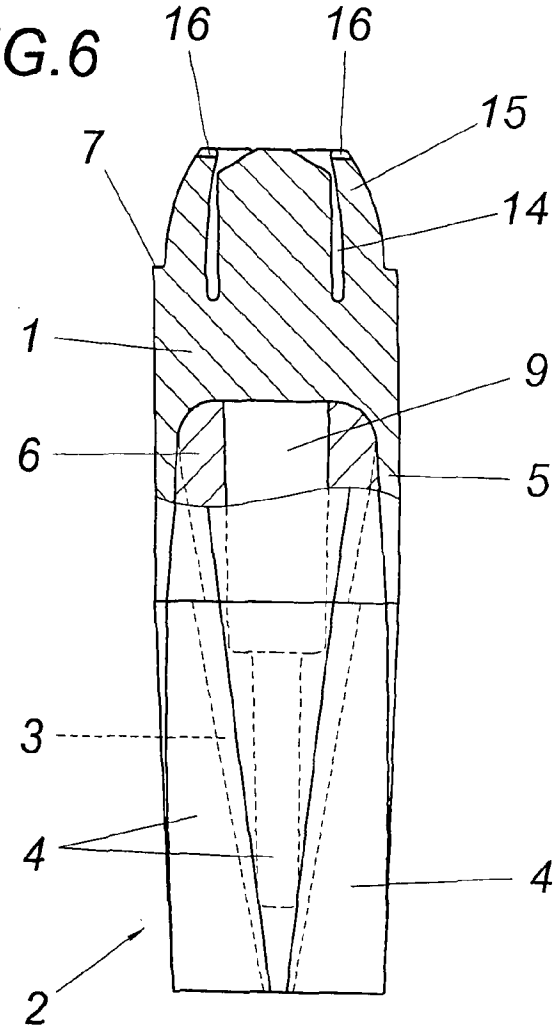
Figure 5:
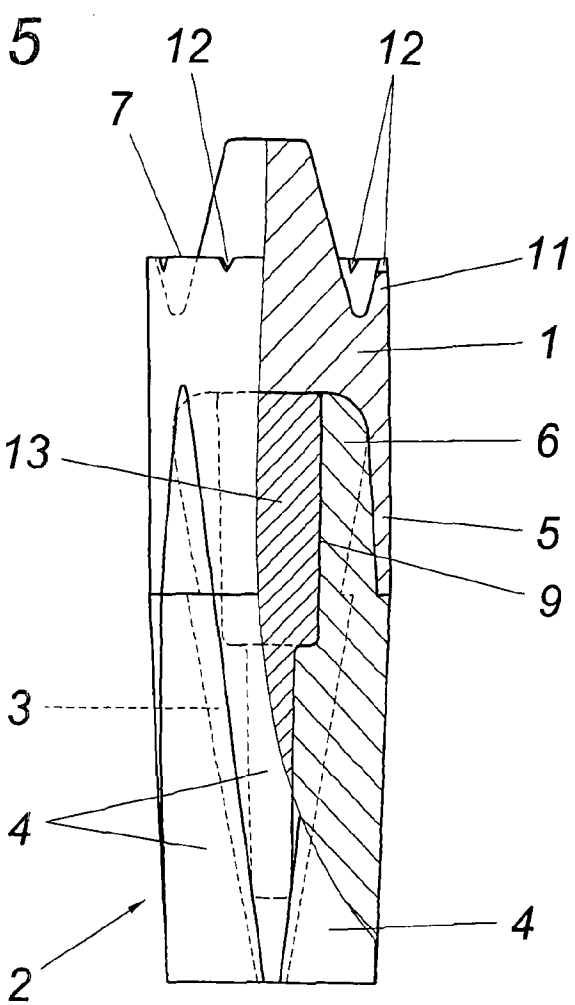

According to FIG. 6, the projectile head 1 is provided on its front face with an annular recess 14 coaxial to the projectile longitudinal axis, which separates an external annular bead 15 from the remaining projectile head 1. This annular bead 15 again has notches 16 distributed around the circumference to achieve tearing open of the annular bead 15 upon impact, and thus improve the effect of the projectile. According to FIG. 7, the projectile head 1 forms a centric recess 17 coaxial to the projectile axis, so that an annular bead 15 again results, which is provided with radial notches or slots 18 for tearing open, to ensure spreading open of the projectile head 1 along these slots 18.

Figure 8:
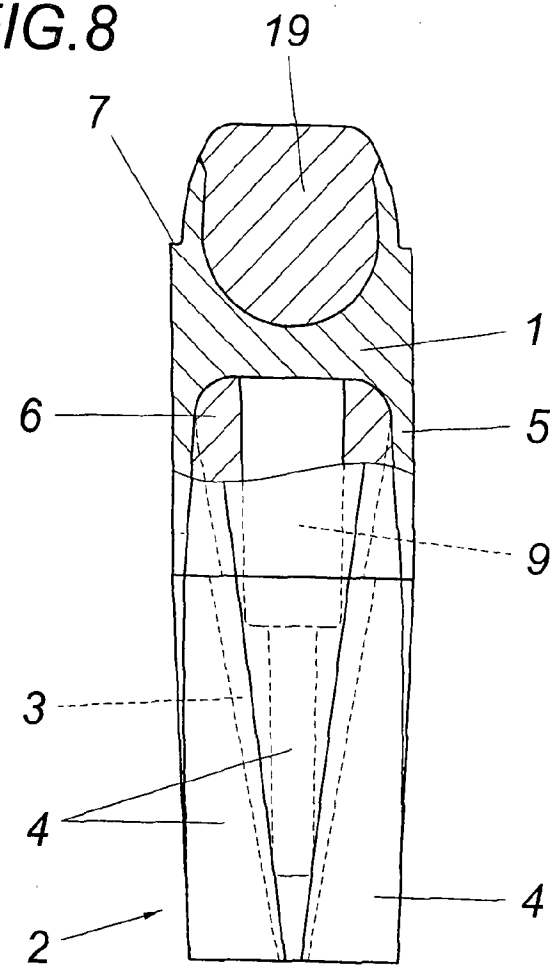
Figure 7:
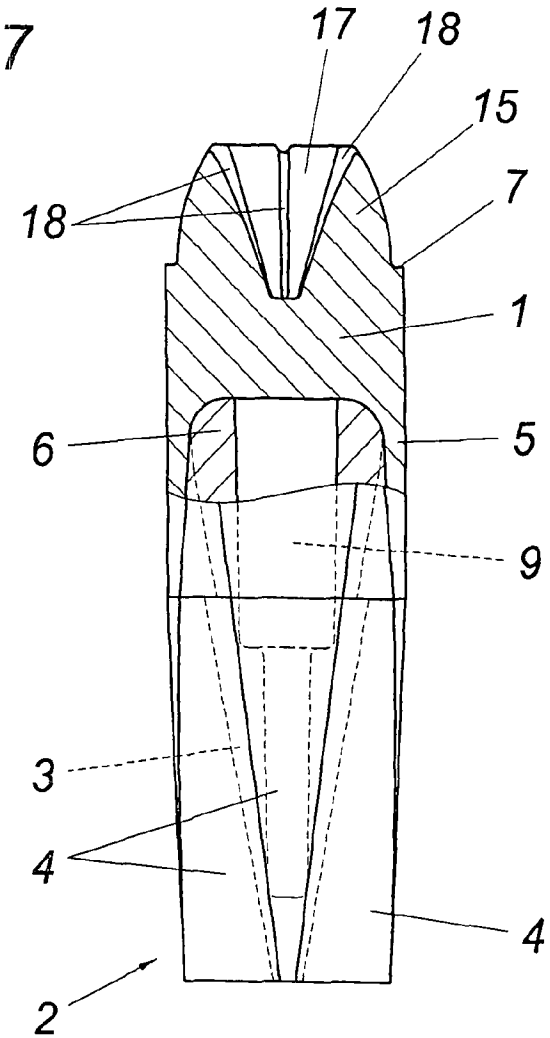

A projectile head 1 which has an insert 19 made of a heavier or softer material than the remaining projectile head 1 is illustrated in FIG. 8. With a heavier insert 19, the penetrative force of the projectile is increased. If the insert 19 is softer, the plastic deformation of the insert 19 upon incidence of the projectile on a target may be used for a special projectile effect.

Figure 9:
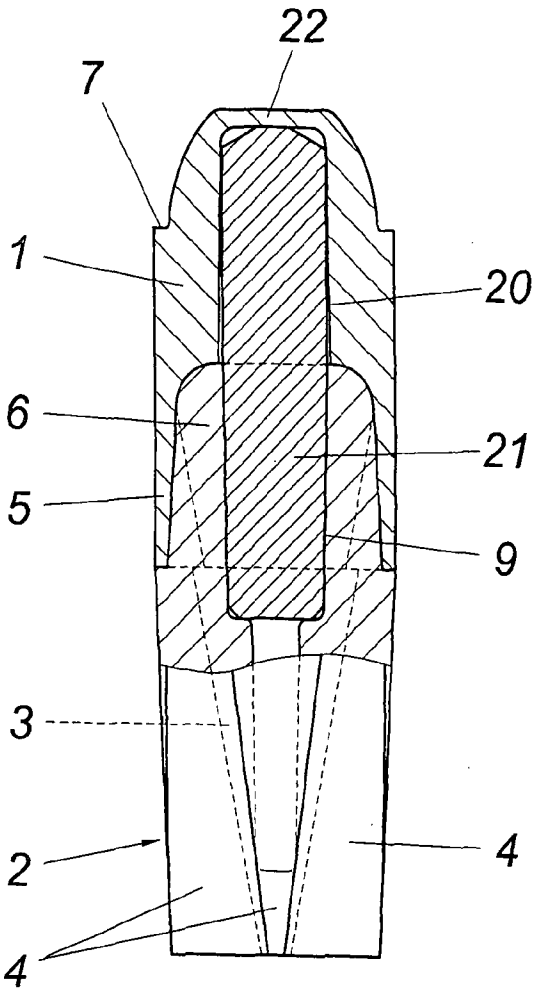

According to FIG. 9, the projectile head 1 forms an opening 20 lengthening the cavity 9 of the tail unit 2 for receiving a hard projectile core 21 extending into the cavity 9 of the tail unit 2, which is axially secured when the projectile head 1 is clamped on the tail unit 2 by folding in the projectile wall 5 between the projectile head 1 and the tail unit 2. This projectile core 21, which is manufactured from steel, for example, penetrates the front wall 22 of the projectile head 1 upon incidence of the projectile on a target, to penetrate deeper into the target.

Figure 10:
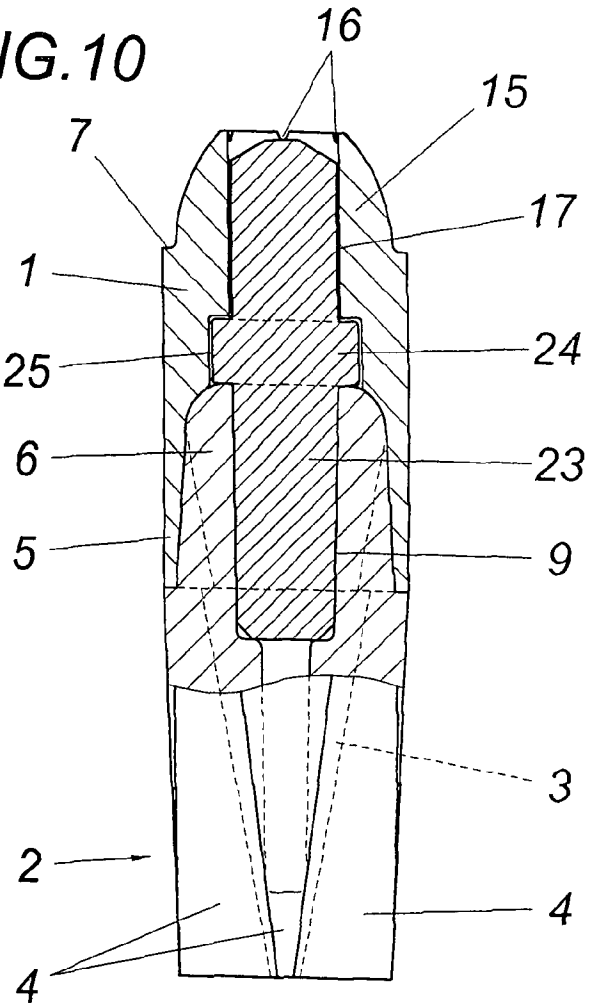

The projectile according to FIG. 10 is provided with a spreading core 23, which is inserted into a centric recess 17 of the projectile head 1 extending up to the cavity 9 of the tail unit 2 and projects into the cavity 9. This spreading core 23 has an annular shoulder 24, which engages in an expansion 25 of the recess 17 of the projectile head 1 adjoining the tail unit 2. Upon incidence of the projectile on a target, the kinetic energy of the spreading core 23 causes the annular bead 15, which is formed by the recess 17 and provided with notches 16, to be additionally expanded via the annular shoulder 24 after tearing open, which increases the effect of such a projectile.

The invention claimed is:

1. A sub-caliber projectile unit-comprising:

(a) a sub-caliber projectile comprising:

(i) a projectile head comprising a cavity and a circumference wall; and (ii) a tail unit coupled to said cavity (iii) a plurality of guide vanes, extending along said tail unit and up into said projectile head wherein said guide vanes on said tail unit are configured to receive said circumference wall of said projectile head, wherein said circumference wall forms a fold extending into said tail unit guide vanes;

b) a sub-caliber projectile receptacle configured to house said projectile head and said tail unit and wherein said sub-caliber projectile receptacle is removable and is configured to be separated from said projectile head during exit from a barrel.

2. The projectile according to claim 1, wherein said tail unit comprises a main body tapering away from said projectile head, and wherein said guide vanes taper off toward said projectile head and project radially from said main body.

3. The projectile according to claim 1, wherein said tail unit is hollow.

4. The projectile according to claim 3, further comprising an auxiliary compound which is inserted in said tail unit.

5. The projectile according to claim 1, wherein said tail unit comprises a set back section which is set back by at least a thickness of a wall of said projectile head, and wherein said set back section receives said projectile head.

6. The projectile according to claim 1, wherein said guide vanes of said tail unit form a control surface, said control surface being inclined in relation to an axial plane in a rearward area of said tail unit.

7. The projectile according to claim 1, wherein said projectile head has a setback annular shoulder providing axial support for said sub-caliber projectile receptacle.

8. The projectile according to claim 7, wherein said setback annular shoulder comprises an axial annular web, said axial annular web having radial notches or slots distributed circumferentially around said setback annular shoulder.

9. The projectile according to claim 1, wherein said projectile head has an annular bead formed by a centric or annular recess on a front face of said projectile head, wherein said front face has radial notches or slots distributed circumferentially around said annular bead.

10. The projectile according to claim 9, wherein said tail unit comprises a tail unit cavity, wherein said centric or annular recess in said projectile head extends to said tail unit cavity; the projectile further comprising:

a spreading core configured to project into said tail unit cavity, wherein said spreading core is inserted into said centric recess, and an annular shoulder which is configured to engage with said centric recess in an expansion of said centric recess provided adjoining said tail unit in said projectile head.

11. The projectile according to claim 1, wherein said projectile head has an insert made of a heavier material.

12. The projectile according to claim 1, wherein said tail unit comprises a tail unit cavity, wherein said projectile head comprises an opening, the projectile further comprising:

a hard projectile core and wherein said opening receives said hard projectile core extending into said tail unit cavity.

13. The projectile as in claim 1, wherein said circumference wall is coupled to a groin area of said guide vanes.

14. The projectile as in claim 1, wherein said guide vanes are inclined relative to a longitudinal axis of the sub-caliber projectile, and wherein said circumference wall is coupled into said tail unit guide vanes to contact said tail unit guide vanes, and to form an incline relative to the longitudinal axis of the sub caliber projectile.

15. The projectile as in claim 1, wherein said guide vanes are formed on an exterior surface of said projectile head and said tail unit.

16. The projectile as in claim 1, wherein said guide vanes are configured to form a continuous transition between said projectile head and said tail unit on an external surface of said projectile head and said tail unit, which results in advantageous flow conditions for the projectile.

17. A sub-caliber projectile for insertion into a projectile receptacle, said projectile comprising:

(a) a projectile head comprising a cavity; and (b) a tail unit engaging in said cavity and forming guide vanes, extending up into said projectile head;

wherein said projectile head is coupled into grooved areas between said guide vanes and wherein said projectile head and said tail unit comprise a sub caliber projectile;

wherein said tail unit comprises a tail unit cavity, wherein said projectile head has a centric or annular recess in said projectile head which extends to said tail unit cavity, a spreading core configured to projects into said tail unit cavity, wherein said spreading core is inserted into said centric recess, and an annular shoulder configured to engage with said centric recess in an expansion of said centric recess of said projectile head and and wherein said annular shoulder is disposed adjoining said tail unit.

18. A sub-caliber projectile for insertion into a projectile receptacle, said projectile comprising (a) a projectile head comprising a cavity; and (b) a tail unit engaging in said cavity and forming guide vanes, extending up into said projectile head;

wherein said projectile head is coupled into grooved areas between said guide vanes and wherein said projectile head and said tail unit comprise a sub caliber projectile;

wherein said tail unit comprises a tail unit cavity, wherein said projectile head comprises an opening, and a hard projectile core wherein said opening receives said hard projectile core which extends into said tail unit cavity.

* * * * *